US006016934A

United States Patent [19]

Moriguchi

[11] Patent Number: 6,016,934

[45] Date of Patent: Jan. 25, 2000

[54] SPRAY CAN AND METHOD FOR USING THE SAME

[75] Inventor: Yoshikazu Moriguchi, Nagoya, Japan

[73] Assignee: Fuji Koeki Co., Ltd., Aichi, Japan

[21] Appl. No.: 09/057,282

[22] Filed: Apr. 8, 1998

[30] Foreign Application Priority Data

Apr. 11, 1997 [JP] Japan ..... 9-093478

[51] Int. Cl.[7] ..... B65D 83/00

[52] U.S. Cl. ..... 222/1; 222/400.7; 222/402.18; 222/402.19; 222/464.2

[58] Field of Search ..... 222/402.18, 464.2, 222/400.7, 402.1, 401, 402.19

[56] References Cited

U.S. PATENT DOCUMENTS

| | | | |
|---|---|---|---|
| 1,938,036 | 12/1933 | Martin et al. | 222/402.18 X |
| 3,260,421 | 7/1966 | Rabussier | 222/402.18 |
| 3,733,009 | 5/1973 | Rouzier et al. | 222/402.18 X |
| 4,228,933 | 10/1980 | Elson | 222/400.7 |
| 4,247,025 | 1/1981 | Gailitis | 222/402.18 |
| 5,048,721 | 9/1991 | Gittens et al. | 222/464.2 X |
| 5,143,288 | 9/1992 | Kohler et al. | 222/402.18 X |

FOREIGN PATENT DOCUMENTS

| | | |
|---|---|---|
| 9-150876 | 6/1997 | Japan . |
| 9-175996 | 7/1997 | Japan . |

*Primary Examiner*—Kevin Shaver
*Assistant Examiner*—David Deal
*Attorney, Agent, or Firm*—Merchant & Gould P.C.

[57] ABSTRACT

A spray can capable of using compressed air that is used in a plant and of generating spray regardless of the viscosity of a liquid. The spray can comprises a can main body into which liquid is collected and compressed air is filled and generates spray by ejecting the liquid from a nozzle portion through a dip tube by using the air pressure in the can main body. An opening for filling air is formed on the can main body, and the dip tube has at least one air hole pierced at a location above the surface of the liquid.

13 Claims, 7 Drawing Sheets

| | The location of an air hole of the dip tune | The number of time of ejection (in an amount of usable oil mist and oil agent) |
|---|---|---|
| LB-6000 | 50mm | 120 – 140 |
| | 80mm | 160 – 180 |
| | 120mm | 180-200 (until 150th, oil mist was fine) |
| | 140mm | 220-250(from the first, particles of mist was rough) |
| LB-2000 | 50mm | 30 – 50 |
| | 100mm | 70 – 80 |
| | 120mm | 80 – 100 |
| | 140mm | 120 – 140 |

Fig. 6

SPRAY CAN AND METHOD FOR USING THE SAME

FIELD OF THE INVENTION

The present invention relates to a spray can capable of generating spray.

BACKGROUND OF THE INVENTION

In machine work or assembly work, cutting oil or lubricant oil is essential. In the field of oil filling, as compared with the case where liquid type oil is used, in the case where spray that is a fog type oil agent is used, higher lubrication effect or cooling effect can be provided since the oil agent can be spread over the entire places. From such reasons, spray is widely used in the field of oil filling.

Herein, in a machining center or large lathe etc, oil agents can be filled and sprayed automatically by a specific oil filler. However, in a general purpose milling machine or a drilling machine, a disposable spray can that can be used easily and simply as is used a manual oil filler for oil filling.

This spray can generates spray as follows: a liquefied gas such as LP gas, freon gas etc. as a propellant is filled in a collected oil agent in a can to mix oil agent in the can with the liquefied gas; when a valve is opened by pushing down an actuator at the top of the spray can by finger tip, the propellant is evaporated in the can; the above mentioned mixed liquid is ejected from a pore of a nozzle by the pressure of the evaporated propellant; and when the propellant is released into atmosphere, it is rapidly evaporated and further breaks formulated concentrate particles of the oil agent into fine spraying particles, and thus spray is generated. In this spray can, using a liquefied gas as a propellant permits making the internal pressure of the can relatively low, i.e. in the range of 100 to 600 kPa (equivalent to about 1 to 6 kgf/cm$^2$). Also the container is thin and able to be used easily and simply. However, such a spray can required 75 to 60% of liquefied gas and a container so as to spray 25 to 40% of oil agent.

Also, it is difficult for users to refill liquefied gas that is a propellant after the oil agent is used up, because excessive equipment or maintenance is required. Consequently, users have to return empty containers to the maker after use, or dispose of them. Therefore, in general, users purchase such spray cans at moderate price and manage them as consumables by disposing of them after using.

However, in particular, in a plant where machine work is conducted, since there are many places to which spray is sprayed for lubrication or cooling, a large number of spray cans are often purchased at one time. A wide variety of consumables other than spray cans are also purchased, so that inventory control becomes complicated and room for storing inventory goods is necessary. Furthermore, in the case of disposing of the spray cans, it is necessary to pierce spray cans so that the internal pressure is released to the outside. Therefore, users have to take a responsibility in such management.

In order to solve the above mentioned problems, a reusable spray can is found and provided. The reusable spray can generates spray by using air pressure by filling compressed air generated by a compressor in plant in the spray can.

This spray can will be explained with reference to figures of the spray can according to the present invention, since the basic elements of this spray can are the same as those of the present invention except a dip tube and an air hole pierced at the dip tube. As shown in FIG. 1, this spray can comprises a neck portion 11 that is removable from a spray can main body 8 at the top of the spray can. As shown in FIG. 2, the spray can is configured so that oil agent is filled in the spray can main body 8 through an opening for filling 81 at the top of the spray can main body 8 when the neck portion 11 is removed. Moreover, the neck portion 11 comprises a nozzle portion 3 in the upper part, and an air filling hole 62 in an air filling portion 6 in the lower part. From the air filling hole 62, compressed air of high pressure is filled. On the other hand, as shown in FIG. 4, a dip tube 51 is connected below the nozzle portion 3. As shown in FIG. 3, the tip of the dip tube 51 extends toward a collected oil agent 82. Moreover, unlike the present invention, in this example, the dip tube 51 whose inner diameter is the same as the external diameter of an attaching portion 41 of the dip tube is used. By filling compressed air in a state where an oil agent is collected and a can is sealed, when a valve 36 is opened, an oil agent 82 flows into the dip tube and liquid can be ejected. Therefore, the use of this spray can permits refilling compressed air from the air filling hole 62 even if the compressed air is used up, and refilling oil agent even if the oil agent 82 of spray can is used up. Thus, it is possible to reuse the same cans.

In this case, the compressed air does not liquefy at a low pressure in the range of 100 to 600 kPa (equivalent to in the range of about 1 to 6 kgf/cm$^2$) and the expansion breaking power is inferior to in the case where the propellant is used. Therefore, as the conditions for forming an oil agent whose viscosity is about 10 mm$^2$/s into spray, the compressed air having the pressure of not less than 550 kPa (equivalent to about 5.5 kgf/cm$^2$) needs to be filled since it is necessary to eject a liquid at high speed in the form of membrane and further in the form of fiber and to provide a shock for spraying.

However, the above mentioned spray can has limits in terms of the pressure of compressed air or the viscosity of oil agent, so that it cannot be adapted to all kinds of oil agent.

For example, if compressed air having high pressure of about 500 kPa (equivalent to about 5 kgf/cm$^2$) is filled, an oil agent having a high viscosity of about 35 mm$^2$/s cannot be formed into spray only to flow out in the liquid state.

Moreover, since such spray cans are used in plant, it has been desired to use compressed air from tubes provided everywhere in plant as it is. However, compressed air formed by a compressor generally placed in plant is generally adjusted to about 500 kPa (equivalent to about 5 kgf/cm$^2$). In addition, the air pressure is sometimes lowered to about 400 kPa (equivalent to about 4 kgf/cm$^2$) because the other equipments are used. Therefore, even if the oil agent whose viscosity is 10 mm$^2$/s is used, sufficient air pressure cannot be obtained by using the above mentioned spray can. On the other hand, when the specific booster in plant is used, cost rises as well as the booster needs to be moved to the required places, and thus an operation becomes complicated.

Moreover, it can be said to be desirable that the use of a straw type nozzle permits operating safely since a user does not need to come closer to a work, and appropriately spraying to a small point such as a tap hole or a drill hole, and that the attachment rate is high and the scattering reduces. However, as compared with the other type of nozzle, the oil agent cannot easily be particulated by the straw type nozzle unless air pressure is increased.

SUMMARY OF THE INVENTION

It is the object of the present invention to avoid the above mentioned problems by providing a filling type spray can capable of generating spray regardless of whether the viscosity of liquid is high or low by using compressed air that is actually provided and used in a plant as it is.

In order to accomplish the above mentioned objects, the spray can of the present invention comprises a can main body into which liquid is collected and compressed air is filled and, by operating an actuator and opening a valve, capable of generating spray by ejecting the liquid from a nozzle portion through a dip tube by using the air pressure in the can main body, wherein the dip tube has an air hole pierced at a location above the surface of the liquid. By such an embodiment of the spray can, since the dip tube is provided with the air hole, the particulation of the liquid is promoted, so that spray is able to easily be generated even if the viscosity of the liquid is high or the air pressure is low.

It is preferable in the above mentioned spray can that the liquid is oil agent. By such an embodiment of the spray can, since it is possible to change the oil agent into spray, lubrication effect and cooling effect can be improved by filling a spray of oil agent in a machine work or an assembly work.

It is preferable in the above mentioned spray can that, by opening the bulb, the compressed air in the can main body can be mixed with the liquid in the dip tube through the air hole. By such an embodiment of the spray can, the particulation of the liquid can be promoted.

It is further preferable that the can main body is provided with an air filling hole. By such an embodiment of the spray can, compressed air can be refilled in the can.

It is further preferable that the can main body comprises a removable neck portion, and liquid can be filled in the can main body by removing the neck portion. By such an embodiment of the spray can, the liquid can be refilled in the can.

It is further preferable that the dip tube has two air holes located facing each other. By such an embodiment of the spray can, the compressed air in the can is easily mixed with the liquid in the dip tube.

It is further preferable that the air hole has a tapered shape in which the diameter at the inside of the dip tube is smaller than the diameter at the outer surface of the dip tube. By such an embodiment of the spray can, the compressed air in the can is easily mixed with the liquid in the dip tube.

It is further preferable that the inner diameter of the dip tube is in the range of 1 to 2 mm. By such an embodiment of the spray can, plenty of oil agent can be mixed sufficiently with the liquid even if the air pressure is low or the viscosity of the liquid is high.

It is further preferable that the dip tube reduces the inner diameter of the pipe of the side of the liquid by connecting through a connecting tube. By such an embodiment of the spray can, the inner diameter of the dip tube can be reduced easily.

It is further preferable that the dip tube reduces the inner diameter of the pipe of the side of the liquid side by connecting to the facing tube by expanding the diameter of the upper end of the dip tube. By such an embodiment of the spray can, the inner diameter of the dip tube can be reduced easily.

It is further preferable that the location of said air hole in the vertical direction can be altered by exchanging said dip tubes. By such an embodiment of the spray can, it is possible to generate the best spray from different kinds of oil agents.

It is further preferable that the air pressure of the compressed air to be filled in the can main body is not less than 400 kPa. By such an embodiment of the spray can, it is possible to generate the best spray from different kinds of liquid.

It is further preferable that the viscosity of the liquid is not more than 35.4 $mm^2/s$. By such an embodiment of spray can, it is possible to generate spray by particulating the liquid.

Next, according to the present invention, a method for using a spray can comprising a can main body into which liquid is collected and compressed air is filled and a dip tube having an air hole pierced at the location above the surface of the liquid, and, by operating an actuator and opening a valve, capable of generating spray by ejecting the liquid from a nozzle portion through a dip tube due to an air pressure in the can main body; wherein a plurality of exchangeable dip tubes having air holes located in different positions, whereby, by changing dip tubes, a location of the air hole relative to the height of the spray can may be altered and the conditions of spray can be altered. By such an embodiment of the method for using the spray can, the best spray can be generated from different kinds of oil agents.

BRIEF DESCRIPTION OF THE DRAWINGS

FIG. 6 shows results of a comparative experiment with respect to location of the air hole and the number of ejections from the can.

FIG. 8 is a sectional side view of a dip tube having a air hole with a tapered shape.

DETAILED DESCRIPTION OF THE INVENTION

Hereinafter, the present invention will be explained with reference to the figures of one embodiment.

Figure 1:
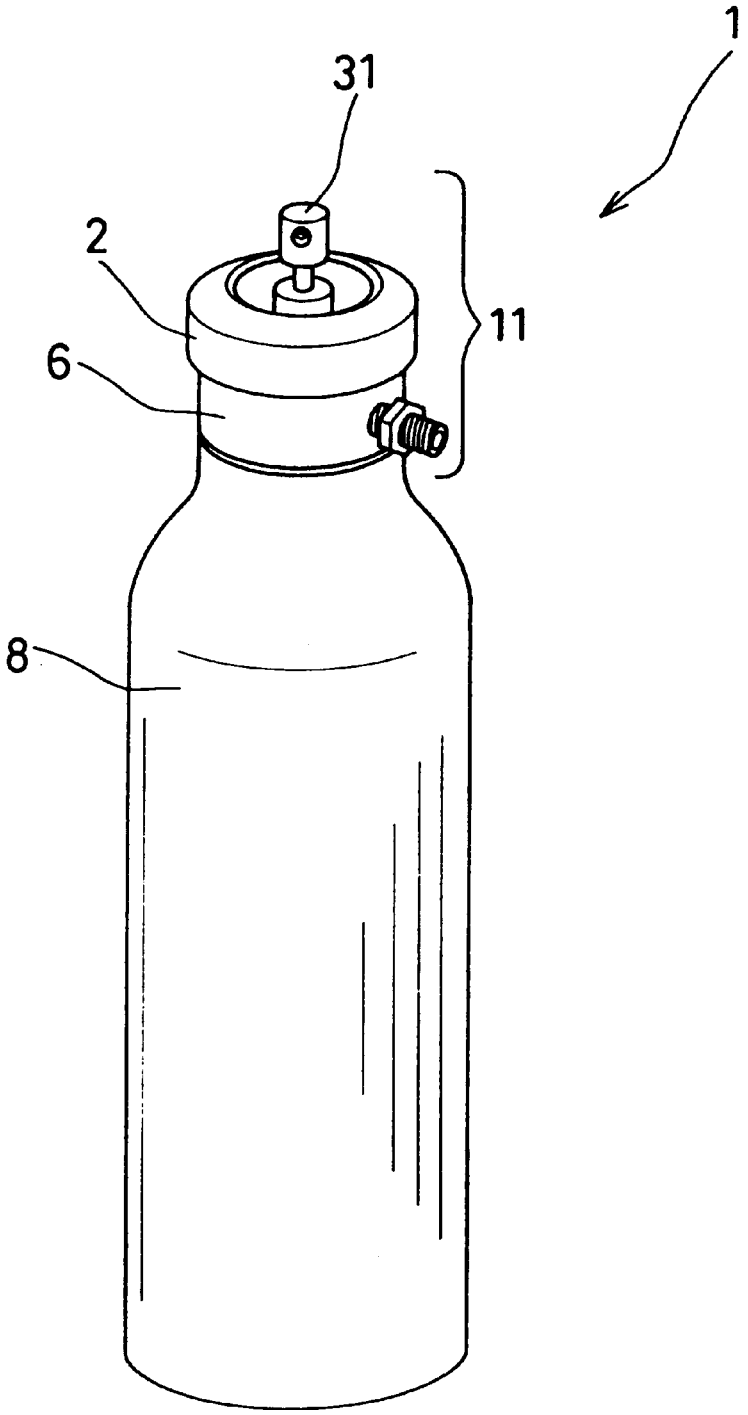
FIG. 1 is a perspective view of a spray can.
Figure 2:
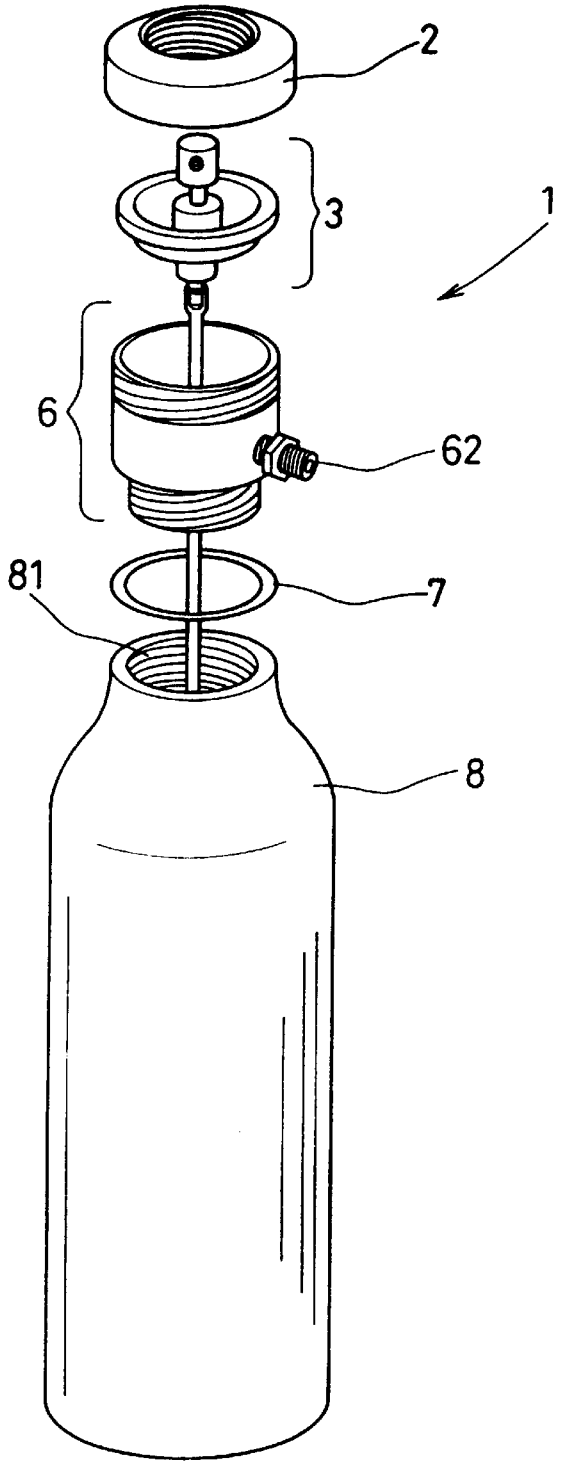
FIG. 2 is an exploded view of a spray can.
Figure 3:
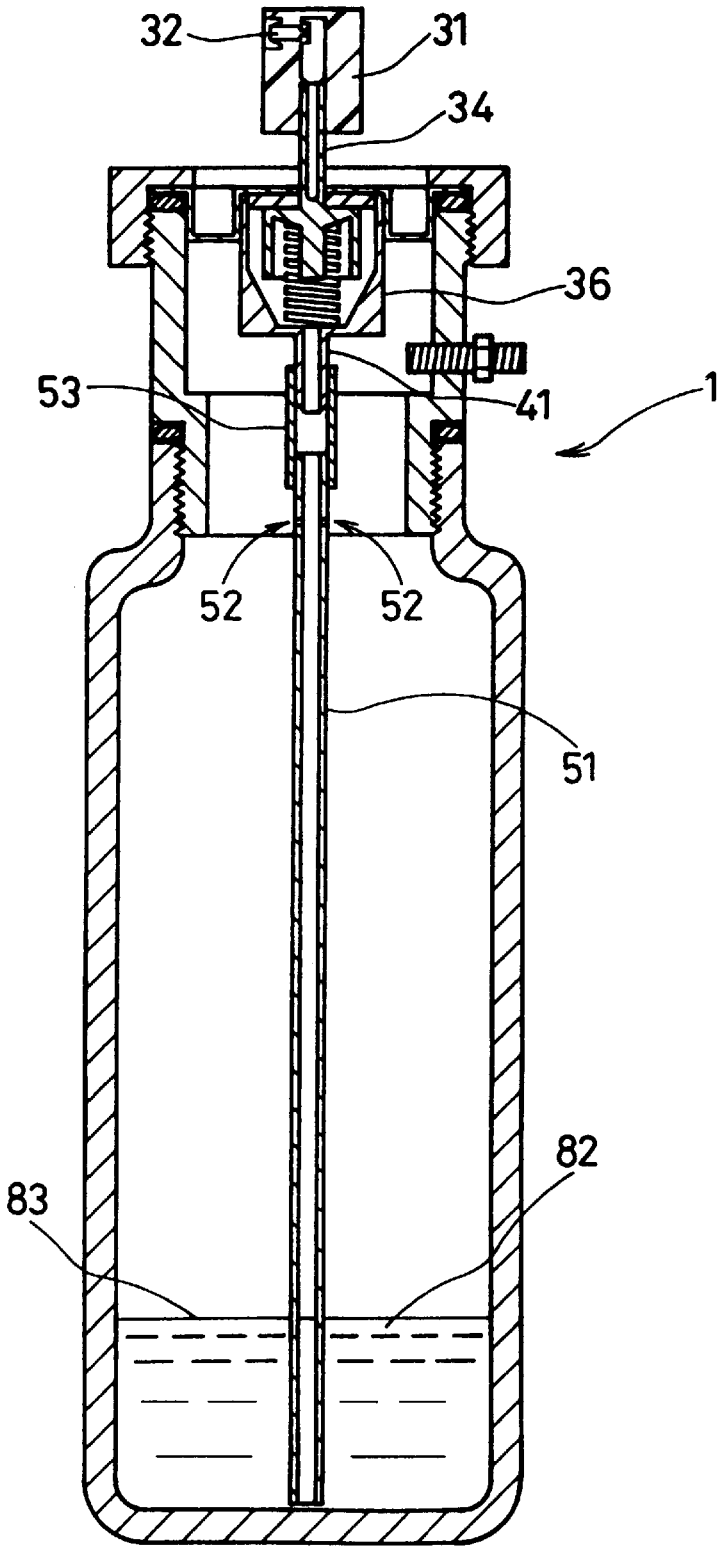
FIG. 3 is a sectional view of a spray can.

As shown in FIGS. 1 to 3, a spray can 1 of this embodiment comprises a spray can main body 8 having an opening for filling 81 formed at the top thereof; the neck portion 11 provided at the top of the spray can main body 8 and having a nozzle portion 3 in the upper part and an air filling portion 6 in the lower part. At the trunk part of the air filling portion 6, an air filling hole 62 is formed. From the air filling hole 62, compressed air that is generated by a compressor in plant is filled in the can. Moreover, an oil agent 82 can be filled through the opening for filling 81 of the can main body 8.

Figure 4:
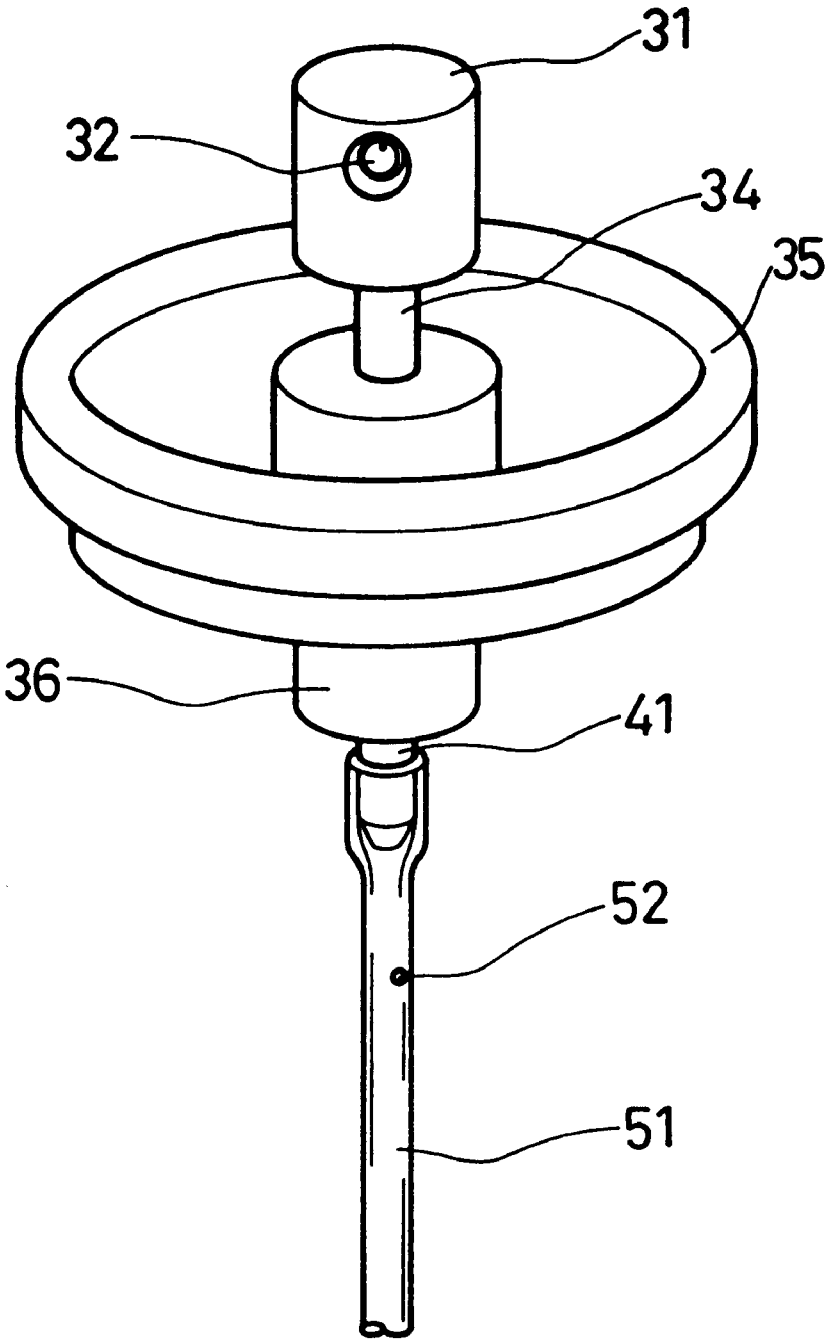
FIG. 4 is an enlarged perspective view of a nozzle portion.
Figure 5:
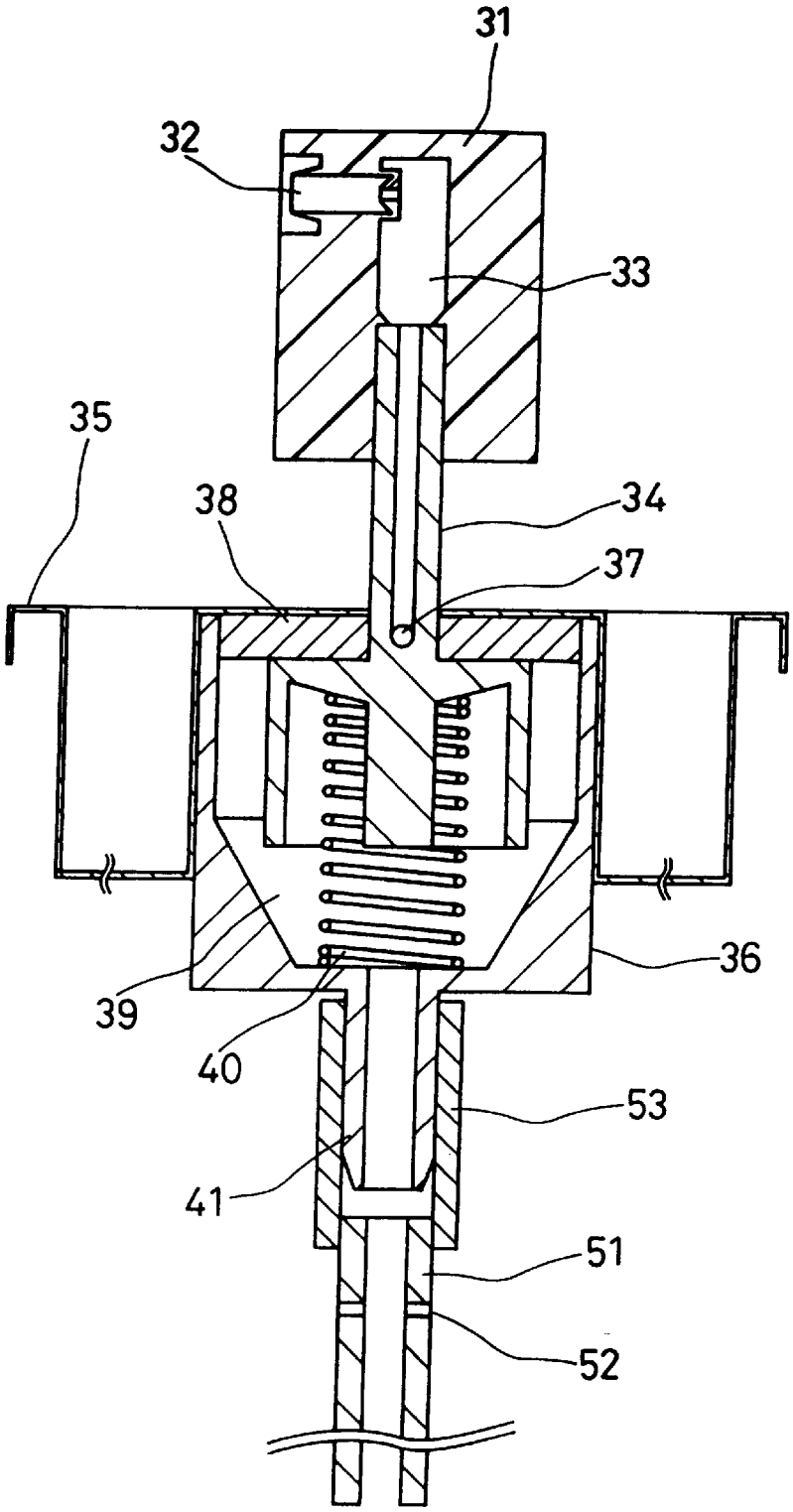
FIG. 5 is a sectional side view of a nozzle portion.

As shown in FIGS. 4 and 5, the nozzle portion 3 comprises an actuator 31 having a nozzle 32, a stem 34 connecting the actuator 31 with a valve 36, and a valve 36. In this configuration, the pressed oil agent 82 that is collected in the spray can main body 8 ejects to the outside as a spray from the nozzle 32 through the dip tube 51, a valve housing 39, the stem 34, and an actuator air chamber 33, when the valve 36 is opened by pushing down the actuator 31. The configuration of the nozzle and valve etc. is not limited to the above mentioned configuration alone and may be any generally known configurations having the same functions.

As shown in FIG. 3, a dip tube attaching portion 41 is provided below the nozzle portion 3. The dip tube 51 is connected to the attaching portion 41 through a tube of large diameter 53. The lower end of the dip tube 51 extends to the collected oil agent 82, and allows the oil agent to flow into the dip tube 51.

The dip tube 51 is provided with two air holes of small diameter 52 at a location above the surface 83 of oil agent in such a way as to be facing each other. The number of the air holes of small diameter is not limited to two alone, and may be one or more than two.

As to the dip tube, in the conventional spray can using high air pressure, the inner diameter of the tube is thick, namely, in the range of 2 to 3 mm. Therefore in a case where the air hole 52 is provided, sufficient air is not mixed with respect to the amount of the oil agent. However, in the present invention, as shown in FIGS. 3 and 5, by using the tube of large diameter 53 whose inner diameter is the same as the outer diameter of the dip tube attachment portion 41, the dip tube 51 whose inner diameter is thinner of in the range of 1 to 2 mm can be attached. By such an embodiment, the inner diameter of the dip tube can easily be made thinner, thus ensuring the sufficient mixing ratio of air to the oil agent even if air pressure is low or the viscosity of the oil agent is high. Moreover, as shown in FIG. 4, by such an embodiment where the upper end of the dip tube of small diameter is made to expand by heating or other physical power and to equalize the inner diameter with the outer diameter of the attaching portion 41 of the dip tube, the same results can be obtained.

Moreover, as to the air hole 52, any sizes or any shapes may be used. The shape may be a tapered shape in which the hole diameter becomes narrower as it is closer to the inside so that air filled in the spray can is easily mixed with the oil agent. See FIGS. 5 and 8.

The optimum location of the air hole 52 will be described later in this specification.

Next, an operation of generating spray by the above mentioned spray can 1 by filling oil agent and compressed air will be explained hereinafter.

The neck portion 11 is removed. Oil agent is filled in the spray can main body from the opening for filling 81 of the can main body in an amount of about the half to two-thirds. Then the neck portion 11 is tightened by hands, and compressed air is filled in the spray can main body from the air filling hole 62. It is preferable that the air pressure is generally not less than 550 kPa (equivalent to about 5.5 kgf/cm$^2$). However, in the present invention, it may be as low as 400 kPa (equivalent to about 4 kgf/cm$^2$). Then, the shape of the nozzle may appropriately be selected and attached in accordance with the viscosity of the oil agent or in accordance with the size or shape etc. of the work. Then, all that is needed is to push down the actuator 31. By pushing down the actuator 31, the air pressure in the spray can is generated and oil agent is pressed into and ejected through the hole of the lower end of the dip tube 51 due to the air pressure in the spray can, and at the same time, the compressed air is filled from the air hole 52 and mixed with the oil agent. The oil agent whose viscosity is lowered as a whole because the air is mixed moves upwards at high speed within the dip tube 51, thus promoting the sucking of the oil agent. The oil agent containing air enters the valve housing 39 through the dip tube 51 and a liquid state of oil agent is particulated to some extent due to reduced pressure and shock. Moreover, the oil agent is introduced into the actuator air chamber 33 through the stem 34. At this time, the oil agent enters the actuator air chamber 33 through the hole of the stem 34 at high speed, so that a breaking progresses and the particulation is promoted. Then, the oil agent is ejected from opening 32 of the nozzle. When the oil agent is ejected, its pressure is reduced to the atmospheric pressure. At this time, if air is mixed with the oil agent, the oil agent expands and forms liquid particles into fine spray particles usable as a spray. This effect cannot be observed when air is hardly included in the oil agent.

Therefore, if the dip tube 51 is provided with the air hole 52, as compared with the case of the air hole 52 being not provided, the particulation of oil agent is promoted, and spray easily can be formed even if the viscosity of oil agent is high or air pressure is low.

Herein, the function of the air hole 52 will be explained with reference to the results of the following experiment. This experiment concerns to the relationship between the number of ejections and the location of the holes when the dip tube 51 is provided with the air hole 52.

The conditions for use were: filling air pressure was 500 kPa (equivalent to about 5 kgfcm$^2$); the amount of oil the agent was 70 ml each; and the surface of the oil agent was about 30 mm height above the bottom of the can. The nozzle to be used was a straw type nozzle. The ejecting angle was about 20 degree downward. Moreover, the inner diameter of the dip tube was 1.75 mm. The tip tube is provided with two air holes in a way that two holes are facing each other, and the diameter of the air hole was 0.8 mm. Each ejecting time was about 0.5 second. The temperature was 25° C. Moreover, the following two kinds of cutting oils were used: the LB-6000 (the product name of ITW Company) whose dynamic viscosity is 8.9 mm$^2$/s (at 40° C.); and the LB-2000 (the product name of ITW Company) whose dynamic viscosity is 35.4 mm$^2$/s (at 40° C.).

Figure 7:
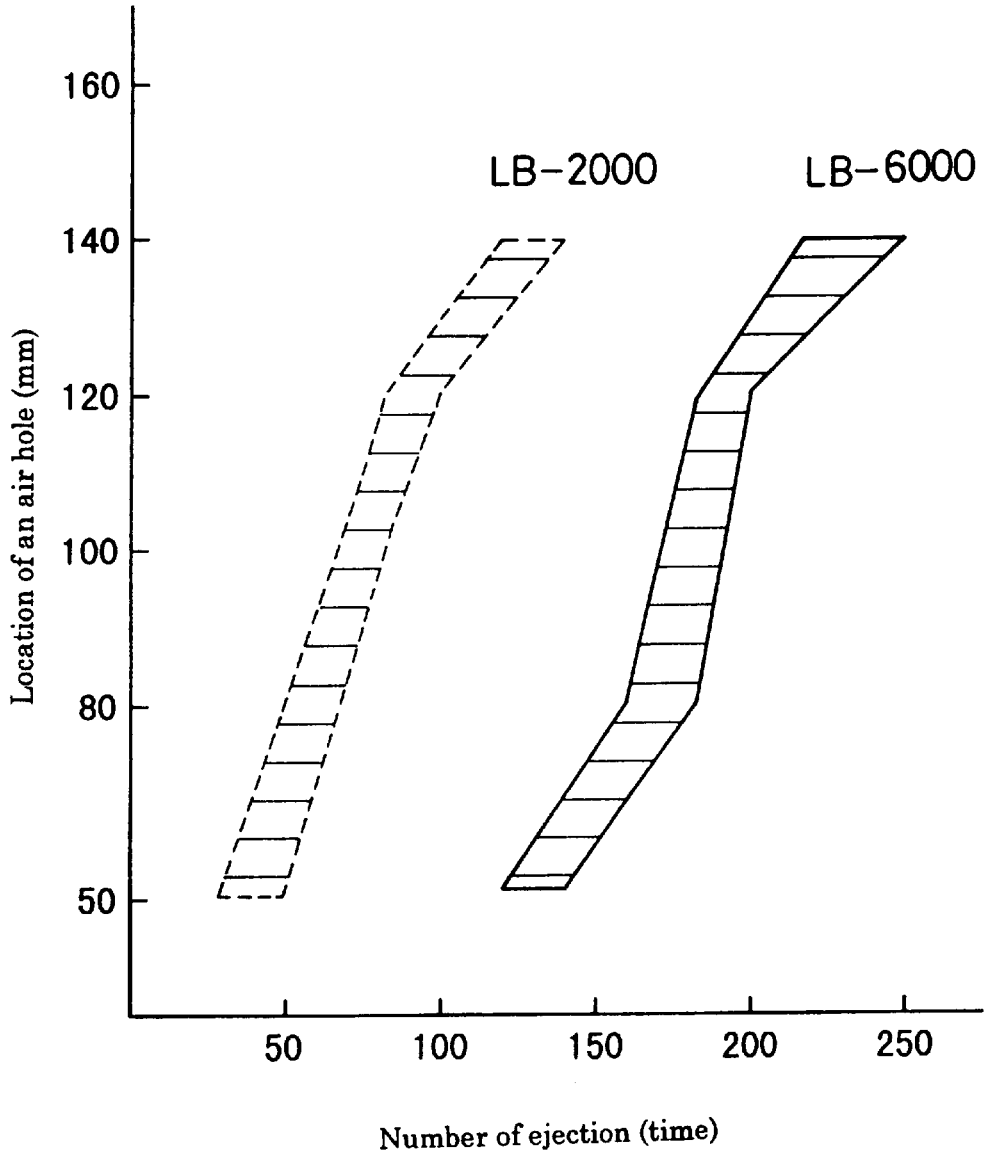
FIG. 7 is a graph showing the results of the experiment.

The results of the experiment are shown in FIGS. 6 and 7. Herein, the location of the hole denotes a distance (the unit is "mm") from the lower end of the flange of a mounting cup 35. From here to the surface of the oil agent is about 160 mm. Moreover, the bottom of the dip tube 51 is located at a distance of 175 mm from the lower end of the flange.

According to the results of the experiment, the number of ejections and the location of the hole is closely related. As the location of the hole is lowered, the number of the ejections increases and the consumption of air is found to be reduced. In the case of the low viscous LB-10 whose viscosity is 8.9 mm$^2$/s, the number of the ejections is relatively increased and the ejection easily occurs. On the other hand, in the case of using the high viscous LB-1 whose viscosity is 5.4 mm$^2$/s, it is difficult to absorb the oil agent due to the high viscosity, unless the location of the hole is lowered. In other words, in the case of using the high viscous oil agent, the location of the hole needs to be lowered.

Moreover, when the location of the hole is low, the number of ejections increases. When the location of the hole is high, the number of ejections is reduced. From this viewpoint, when comparison was conducted under the same viscosity, when the hole is located lower, the ratio of oil part in a spray is increased, the amount of the ejected oil increases and the particle becomes rough. On the contrary, when the hole is located higher, the ratio of the oil part in spray is reduced and the amount of the ejected oil is reduced and its particle becomes fine.

From the result of the experiment, when the dip tube 51 is not provided with the air hole 52, the oil agent is not formed into a spray. However, it is found that, by providing the air hole 52, oil agent can be formed into spray.

Moreover, since the location of the air hole 52 and the state of the particulation of oil agent is closely related, the relationship between the air hole 52 according to the present invention and the particulation is clarified.

Moreover, it is clarified that the most effective location of the air hole 52 is: in the case of using LB-10 as the oil agent, the most effective location is about 120 mm below the lower end of the flange of the mounting cup 35; and in the case of using the LB-1, it is about 140 mm below the lower end of the flange of the mounting cup 35.

Therefore, the location of the air hole 52 of the present invention varies depending upon the viscosity of the oil agent. When the viscosity of the oil agent is high, the location is closer to the surface of the oil agent. And when the viscosity of the oil agent is low, the location is far from the surface of the oil agent. Thus, the most preferable spray can be formed.

Therefore, if a plurality of exchangeable dip tubes 51 having various hole locations are prepared and attached by selecting the dip tube having an optimum hole location depending upon the kinds of oil agents or air pressure, temperature etc., the best state of spray can be obtained easily from different kinds of oil agents.

Moreover, even if the air pressure is 400 kPa (equivalent to about 4 kgf/cm$^2$), although the number of the ejection reduces, spray can be obtained. Also in a case where the amount of oil agent is made to be from 70 to 100 ml or 120 ml, although the optimum location of the air hole 52 moves upward, spray can be obtained.

Moreover, in the embodiment of the present invention, the example in which oil agent is filled in the spray can main body is described. However, other liquid than oil agent may be used. For example, in a case where water is used, spray is able to be generated.

Finally, it is understood that the invention may be embodied in other specific forms without departing from the spirit or essential characteristics thereof. The embodiments disclosed in this application are to be considered in all respects as illustrative and not restrictive, so that the scope of the invention being indicated by the appended claims rather than by the foregoing description, and all changes which come within the meaning and range of equivalency of the claims are intended to be embraced therein.

What is claimed is:

1. A spray can comprising a can main body into which liquid is collected and compressed air is filled and, by operating an actuator and opening a valve, capable of generating a spray by ejecting said liquid from a nozzle portion through a dip tube due to an air pressure in said can main body, said dip tube having an air hole pierced at the location above the surface of the liquid, wherein a plurality of exchangeable dip tubes are provided, having air holes located in different positions, whereby a location of the air hole relative to the height of the spray can may be altered by changing dip tubes.

2. The spray can according to claim 1, wherein said liquid is an oil agent.

3. The spray can according to claim 1, wherein, by operating said valve compressed air in said can main body is mixed with the liquid in said dip tube through said air hole.

4. The spray can according to claim 1, wherein said can main body is provided with an air filling hole.

5. The spray can according to claim 1, wherein said can main body comprises a removable neck portion, and liquid can be filled into said can main body by removing said neck portion.

6. The spray can according to claim 1, wherein said dip tube has two air holes located facing each other.

7. The spray can according to claim 1, wherein said air hole has a tapered shape in which the diameter at the inside of the dip tube being smaller than the diameter at the outer surface of the dip tube.

8. The spray can according to claim 1, wherein the inner diameter of said dip tube is in the range of 1 to 2 mm.

9. The spray can according to claim 1, wherein said dip tube is attached to a tube of large diameter having an inner diameter matching an outer diameter of the dip tube.

10. The spray can according to claim 1, wherein said dip tube has an upper end for connection to a facing tube, the upper end of the dip tube being expanded with respect to a lower portion of the dip tube.

11. The spray can according to claim 1, wherein the air pressure of the compressed air filled in said can main body is not less than 400 kPa.

12. The spray can according to claim 1, wherein the viscosity of said oil agent is not more than 35.4 mm$^2$/s.

13. A method for using a spray can, said spray can comprising a can main body into which liquid is collected and compressed air is filled and a dip tube having an air hole pierced tat the location above the surface of the liquid, and said method comprising:

operating an actuator and opening a valve capable of generating spray by ejecting said liquid from a nozzle portion through a dip due to an air pressure in said can main body;

wherein a plurality of exchangeable dip tubes having air holes located in different positions are provided, and by changing dip tubes, a location of the air hole relative to the height of the spray can may be altered and the particulation conditions of the spray can be altered.

* * * * *